US005117240A

United States Patent [19]

Anderson et al.

[11] Patent Number: 5,117,240

[45] Date of Patent: May 26, 1992

[54] MULTIMODE DIELECTRIC-LOADED DOUBLE-FLARE ANTENNA

[75] Inventors: Ordean S. Anderson, New Prague; Donald E. Anderson, Northfield; Ramakrishna A. Nair, Mankato; Michael J. Riebel, New Ulm, all of Minn.

[73] Assignee: Microbeam Corporation, Kent, Wash.

[21] Appl. No.: 295,805

[22] Filed: Jan. 11, 1989

Related U.S. Application Data

[63] Continuation-in-part of Ser. No. 142,230, Jan. 11, 1988, abandoned.

[51] Int. Cl.[5] ..... H01Q 13/020; H01Q 15/080

[52] U.S. Cl. ..... 343/786; 343/753; 343/783

[58] Field of Search ..... 343/753, 772, 773, 724, 343/783, 786, 911 R, 776, 757

[56] References Cited

U.S. PATENT DOCUMENTS

| | | | |
|---|---|---|---|
| 2,669,657 | 2/1954 | Cutler | 343/786 |
| 3,388,399 | 6/1968 | Lewis | 343/786 |
| 3,624,655 | 11/1971 | Sato | 343/911 R |
| 3,662,393 | 5/1972 | Cohn | 343/786 |
| 3,898,669 | 8/1975 | Blume | 343/786 |
| 4,419,671 | 12/1983 | Noerpel | 343/786 |
| 4,447,811 | 5/1984 | Hamid | 343/783 |
| 4,660,050 | 4/1987 | Phillips | 343/786 |
| 4,731,616 | 3/1988 | Fulton et al. | 343/786 |
| 4,757,324 | 7/1988 | Dhanjal | 343/776 |
| 4,792,814 | 12/1988 | Evbisui | 343/786 |
| 4,873,534 | 10/1989 | Wohlleben et al. | 343/786 |

FOREIGN PATENT DOCUMENTS

| | | | |
|---|---|---|---|
| 0868507 | 10/1941 | France | 343/786 |
| 1095355 | 12/1954 | France | 343/786 |
| 1188206 | 3/1959 | France | 343/911 R |
| 0152105 | 8/1985 | Japan | 343/776 |

OTHER PUBLICATIONS

Nair, R. A., Radiation Behavior of a Dielectric Loaded Double Flare Multimode Conical Horn with a Homogeneous Dielectric Sphere in Front of its Aperture, IEEE Montech '86 Conference, Oct. 1986.

Flare Angel Charges in a Horn Antenna as a Means of Pattern Control, Cohn, Seymor B., Microwave Journal, Oct. 1970.

A high-gain multimode dielectrric coated rectangular horn antenna, Nair, R. A., et al., The Radio and Electronic Engineer, vol. 48, No. 9, pp. 437–443, Sep., 1978.

*Primary Examiner*—Michael C. Wimer
*Assistant Examiner*—Peter Toby Brown
*Attorney, Agent, or Firm*—D. L. Tschida

[57] ABSTRACT

A small aperture horn antenna comprising an outer conical shell and interiorly of which are formed at least first and second conically flared, dielectric-coated stages of differing flare angles which are coupled to one another via an intermediate cylindrical stage. The dielectric coating is applied to form a uniformly smooth horn interior surface. Mountable to the antenna input aperture are various reflective and homogeneous dielectric refractive focusing lenses and to the output is a low noise waveguide converter. A remotely controlled, axial mount assembly enclosed in a gas-filled, roof mountable radome is also disclosed. Alternatively, the same antenna geometry may be used to transmit a directive electromagnetic wave.

33 Claims, 13 Drawing Sheets

MULTIMODE DIELECTRIC-LOADED DOUBLE-FLARE ANTENNA

This is a continuation-in-part of application Ser. No. 07/142,230, filed Jan. 11, 1988, and now abandoned.

BACKGROUND OF THE INVENTION

The present invention relates to communication antennas and, in particular, to a dielectric-coated, multi-flare angle, conical horn antenna for point-to-point communications, particularly home and commercial satellite.

Critical to the performance of any electromagnetic communication system are its transmitting and receiving antennas. The transmitting antenna is used to direct or focus radiated power in a desired direction toward a receiving antenna which is mounted to detect transmitted radiation with a minimum of noise from adjacent directions. The use of directional antennas exhibiting relatively high on-axis gain and minimal off-axis side lobes or other undesired signal characteristics enhances the ability to communicate point-to-point. A further desired attribute of such antennas is an ability to focus or amplify the free-field radiation without cross-polarization, since most communication channels use two linearly polarized signals whose electric fields are oriented at right angles to one another.

Due also to the high cost-per-unit-area of paraboloidal reflectors and interest in developing a television broadcast and/or data communication system using satellites in a geostationary orbit, not to mention satellite communications radar and radio astronomy, considerable interest exists to develop improved feed systems. Appreciating however that there is only one geostationary orbit, the equatorial orbit, it is anticipated that the demand for satellite positions in this orbit will continue to increase. To maximize utilization of this orbit, it will be necessary to space the satellites as closely as possible. This, in turn, will require satellite ground station antennas to radiate circularly polarized elliptical-shaped beams with high gain and directivity at low sidelobe levels. The low sidelobe levels avoid adjacent signal interference.

Moreover, if the cross-polarization radiation level is also kept low, then signals may be received on opposite polarizations, providing the facility of polarization diversity application, that therefore is, sending signals of different polarizations, such as will be necessary to meet various established communication standards. The requirement of antennas to meet this low cross-polarization condition is to have equal E-(Vertical) and H-(Horizontal) plane radiation patterns.

For satellite communications and other special applications, the directional beam may also require steering and thus an antenna with a variable beamwidth facility is preferred. Antennas for radio astronomy applications should have the combined features of low cross-polarization, suppressed sidelobes, a beam-shaping facility and wide bandwidth, in addition to high gain and greater directivity.

Current antennas, which are used to receive microwave and shorter wavelengths, frequently provide a relatively large reflective parabolic collector having broad-band gain characteristics. The collector is constructed to receive and focus the primary signal and side lobes, which are received due to the broad collector acceptance angles, at a separate receiving horn. That is, a co-axially mounted, rear-facing feedhorn capable of receiving broad beam widths, aligned with the signal axis and focal point of the collector, receives the focused signal and directs it to associated receiver electronics which appropriately convert and amplify the signal for its intended application.

The applicants have found however that over a number of bandwidths, centered on frequencies corresponding, for example to C and KU microwave bands, a forward-facing conical antenna having a small aperture, high gain and low side lobe characteristics can be used by itself, independent of a large surrounding collector. The entire antenna exhibits a size comparable to the feedhorn only of many current reflector antennas and in contrast thereto provides a much narrowed signal acceptance aperture.

In the latter regard, presently available home satellite systems predominantly operate at C-band frequencies and use down link antennas which measure ten to sixteen feet in diameter with relatively large flare angle feedhorns. Such antennas correspondingly require a relatively secure mounting system to prevent damage from wind and prevailing weather conditions.

Although the foregoing mounting problems are relatively easily overcome, the physical size of the antenna can present problems to users who reside in relatively dense population areas, especially in high rise buildings. That is, whereas the rural owner usually has available a larger unobstructed yard which permits relative freedom in positioning his/her antenna, the urban user may not have sufficient space to inconspicuously mount the antenna or may have to contend with neighboring structures which block reception. Furthermore, local ordinances or other legal or governmental restrictions may apply with respect to the mounting of such assemblies which may compound the user's problems.

Whereas the higher KU-band frequencies have been considered, as well as set aside for exclusive use with satellite communications, to date only a relatively few such satellites have been positioned in stationary earth orbit. An advantage of such antennas over C-band designs is that the antenna dish, using conventional constructions, can be constructed at diameters within the range of two to six feet, depending upon the transmission power levels of the satellite. Brody H., Big Hopes for Small Dishes, *High Technology Business*, pp. 41–45 (November, 1987). Such antennas, again, are typically constructed using conventional parabolic or other focusing collectors to collect and focus the received so-called "far field" signals onto a rear facing feedhorn, which typically is mounted to the antenna surface and aligned with the collector focal point. In contrast to C-band antennas which may weigh 200 pounds, collector type KU-band antennas commonly weigh only 100 pounds. In the latter regard, Applicants are also aware of an article discussing a flat array, KU-band antenna design. Long M., The Shape of Dishes to Come, *Satellite Orbit*, pp. 35–38 (October, 1987).

In further contrast to the foregoing, the present invention in one embodiment contemplates a KU-band antenna construction which provides for an antenna aperture in the range of only twelve to twenty-four inches and weighs less than five pounds. Numerous other constructions exhibit apertures less than ten inches and horn lengths less than fifteen inches. Such reduced dimensions are achieved through a uniquely arranged configuration of stages which will be described hereinafter. The construction is also such as to be compatible with a number of other frequency bands upon appropriate scaling.

To the extent Applicants are aware of antenna designs including features bearing some similarities of appearance to those of the subject invention, Applicant is aware of U.S. Pat. Nos. 2,761,141; 3,518,686; 3,917,773; and 3,866,234. Such references generally disclose variously shaped dielectric antenna lenses.

Applicants are also aware of U.S. Pat. Nos. 2,801,413; 3,055,004; 4,246,584; and 4,460,901 wherein the use of dielectric structures in association with horn antennas are shown.

Relative to multi-flared feedhorn antenna designs, Applicants are also aware of U.S. Pat. Nos. 2,591,486; 3,898,669; 4,141,015; and 4,442,437. Although disclosing stepped discontinuities within the antenna horn and although U.S. Pat. No. 3,898,669 discloses a multi-flared rectangular horn antenna, none of the noted references discloses the presently claimed combination of features for producing an antenna adaptable to a variety of frequencies, most particularly KU and C-band, and/or an antenna of the reduced dimensions and weight as exhibited by the antenna of the present invention. Such constructions, moreover, are intended for use as rear-facing feedhorns in combination with a large diameter, adjacent collector and not as stand-alone, forward-facing, far-field antennas.

SUMMARY OF THE INVENTION

It is a primary object of the invention to provide an antenna construction useful for receiving and broadcasting a variety of frequencies in point-to-point communications.

It is another object of the present invention to provide an antenna capable of receiving far-field, C-band and KU-band frequencies at signal levels permitting usage in a satellite down link system.

It is a further object of the invention to provide an antenna exhibiting relatively low side lobe levels and cross-polarization to improve the directivity of the antenna relative to geostationary satellites and permit advantageous array configurations.

It is a further object of the invention to provide an antenna of minimal physical dimensions and weight whereby the antenna may be inconspicuously mounted about a home's premises and/or to the roof structure and/or even be personally carried in certain constructions.

It is a further object of the invention to provide a multi-flared, dielectric-coated antenna construction exhibiting useful signal gain and matched stage impedances.

It is a further object of the invention to provide a forward facing antenna including a focusing lens surrounding the signal receiving aperture and/or a dielectric scatterer of a size closely approximating and mounting adjacent the signal receiving aperture for improved reception.

It is a further object of the invention to provide an antenna construction which is collapsible.

It is a yet further object of the invention to provide a remotely controllable, weather-impervious radome construction.

It is a still further object of the invention, due to its suppressed side lobes, to provide a linear or other array construction of antennas of relatively small size with desirable electrical performance.

The foregoing objects and advantages of the invention are particularly achieved in one presently preferred construction which comprises a rigid fiberglass/polyester conical horn. The interior of the horn includes first and second conical stages having half angle tapers which are displaced from one another by one to five degrees and which are coupled to one another via an intermediate cylindrical stage. Covering the antenna interior is a uniform thin film conductor layer and over which is inserted or deposited a dielectric coating to provide a continuous, uniformly smooth taper from the horn aperture to a converter mounted at the antenna vertex. The dielectric coating can be selectively applied to one or more of the conical and cylindrical stages.

In one alternative embodiment, a spacer member, transparent at particular KU, C-band or other frequencies of interest, secures a shaped forward-facing refractive homogeneous dielectric focusing lens to the antenna aperture. The lens may comprise a convex lens of thicker dimension at its center than its edges or a concave lens, among a variety of other focusing shapes. A dielectric scatterer of spherical or other appropriate geometry and density may also be coupled to the outer antenna aperture and appropriately spaced relative thereto, with or without a focusing lens, to tune the antenna.

In another alternative embodiment, reflective lenses of hemispherical or parabolic shape may be used to enhance the outer horn aperture and prefocus received signals.

In still another alternative embodiment, the antenna is configured on a remotely controlled multi-axis drive assembly mounted within a hard, frequency transparent, gas-filled radome enclosure.

Two other embodiments disclose a telescoping horn construction and a linear array mounting.

The foregoing objects, advantages and distinctions of the invention, among others, will become more apparent hereinafter upon reference to the following detailed description thereof with respect to the appended drawings. Before referring thereto, it is to be appreciated the following description is made by way of a presently preferred and various alternative embodiments only, along with presently contemplated modifications thereto, which should not be interpreted in limitation of the spirit and scope of the invention as claimed hereinafter.

DESCRIPTION OF THE PREFERRED EMBODIMENT

Figure 1:
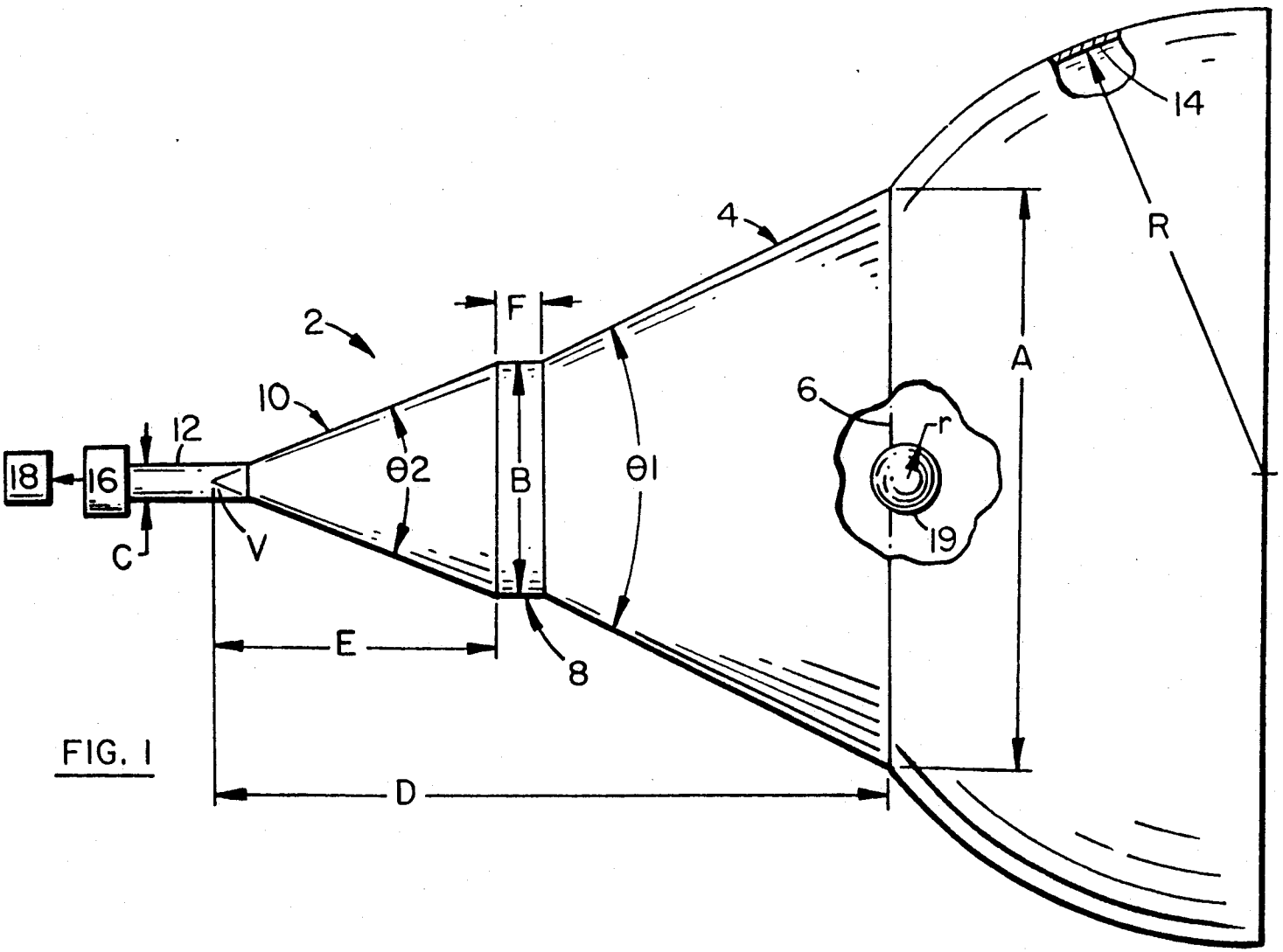
FIG. 1 shows a conceptual line diagram of the various stages of the present antenna.

Referring to FIG. 1, a conceptual line diagram is shown of the stages of the conical horn antenna of the subject invention which is usable in any line-of-sight communication system, including a satellite communication system. As depicted, the antenna assembly 2 comprises a first primary conical stage 4 which tapers from an outer signal receiving aperture 6 of a diameter "A" inwardly at an angular displacement or flare angle of "$\theta 1$" to an intermediate cylindrical coupler stage 8 of a diameter "B". Extending rearwardly from the coupler stage 8 is a second conical stage 10, coaxially positioned with respect to the first stage 4. The stage 10 tapers inward at an angular displacement or flare angle of "$\theta 2$", which is typically one to five degrees less than $\theta 1$, and terminates in coaxial alignment with a circular-to-rectangular waveguide transition region 12 of a diameter "C" at its input which is compatible with a conventional low noise preamplifier or down link converter 16 which couples the received signals at frequencies compatible with the receiver 18. Mounted also to the receiving aperture 6 to improve the antenna's gain characteristics is a forward facing reflective focusing lens or collector 14 which, for FIG. 1, comprises a concave hemispherical dish lens of radius "R". Also depicted is a coaxial spherical, dielectric scatterer 19 of radius "r" which may be used with any reflective or refractive focusing lens 14 or by itself. Whereas the reflective lens 14 seeks to extend the aperture 6 and prefocus incident signals, the scatterer 19 provides a dielectric load to improve the antenna's gain and is tunable by displacing it one way or the other along the longitudinal axis 17. It is believed the scatterer 19, along with various dielectric coatings or inserts which will be described in greater detail below, affect the phasing of the higher order modes of the incident signal to sum or reconstitute these modes with the center mode, instead of having the energy of these modes lost to the side lobes. The dimensions "D", "E" and "F" reflect the relative lengths of the antenna stages 4, 8 and 10.

Depending upon the primary reception frequency, the relative dimensions of each of the stages 4, 8 and 10 may be tailored over an empirically determined range. Thus with reference to Table I below, case 1 lists the dimensions of one antenna built and tested at KU-band frequencies, while case 2 lists the dimensions of a second KU-band antenna believed to be nearer the theoretical optimum dimensions. Case 3 lists dimensions of a third antenna designed for the C-band frequency range.

TABLE I

| | | ANTENNA MEASUREMENTS | | | | | | | | | |
|---|---|---|---|---|---|---|---|---|---|---|---|
| Case | Freq. Band | A (cm) | B (cm) | C (cm) | D (cm) | E (cm) | F (cm) | 01/2 (deg) | 02/2 (deg) | R (deg) | r (deg) |
| 1 | KU | 25 | 5 | 2.5 | 43.8 | 19.1 | 2 | 31.8 | 29.3 | 22.8 | 3.2 |
| 2 | KU | 25 | 5 | 2.5 | 52 | 26 | 2 | 27 | 21.8 | 30 | 3.8 |
| 3 | C | 75 | 15 | 7.5 | 156 | 78 | 6 | 27 | 21.8 | 90 | 11.4 |

As well as empirically constructing antennas exhibiting the foregoing dimensions, the antenna structure of FIG. 1 was analytically evaluated and compared both electrically and economically to conventionally, parabolic reflectors and corrugated conical feedhorn antennas. Pursuant to such electrical attribute studies, improved on-axis gain levels, suppressed side lobe levels, equal E and H-plane beam widths (i.e. low cross polarization) and a variable beam width facility were demonstrated. Ultimately, the studies, as confirmed by actual measurements, have shown the construction of FIG. 1 to produce comparable electrical performance to existing reflector antennas, with advantages of relatively small size, light weight and relatively low costs of manufacture.

Figure 2:
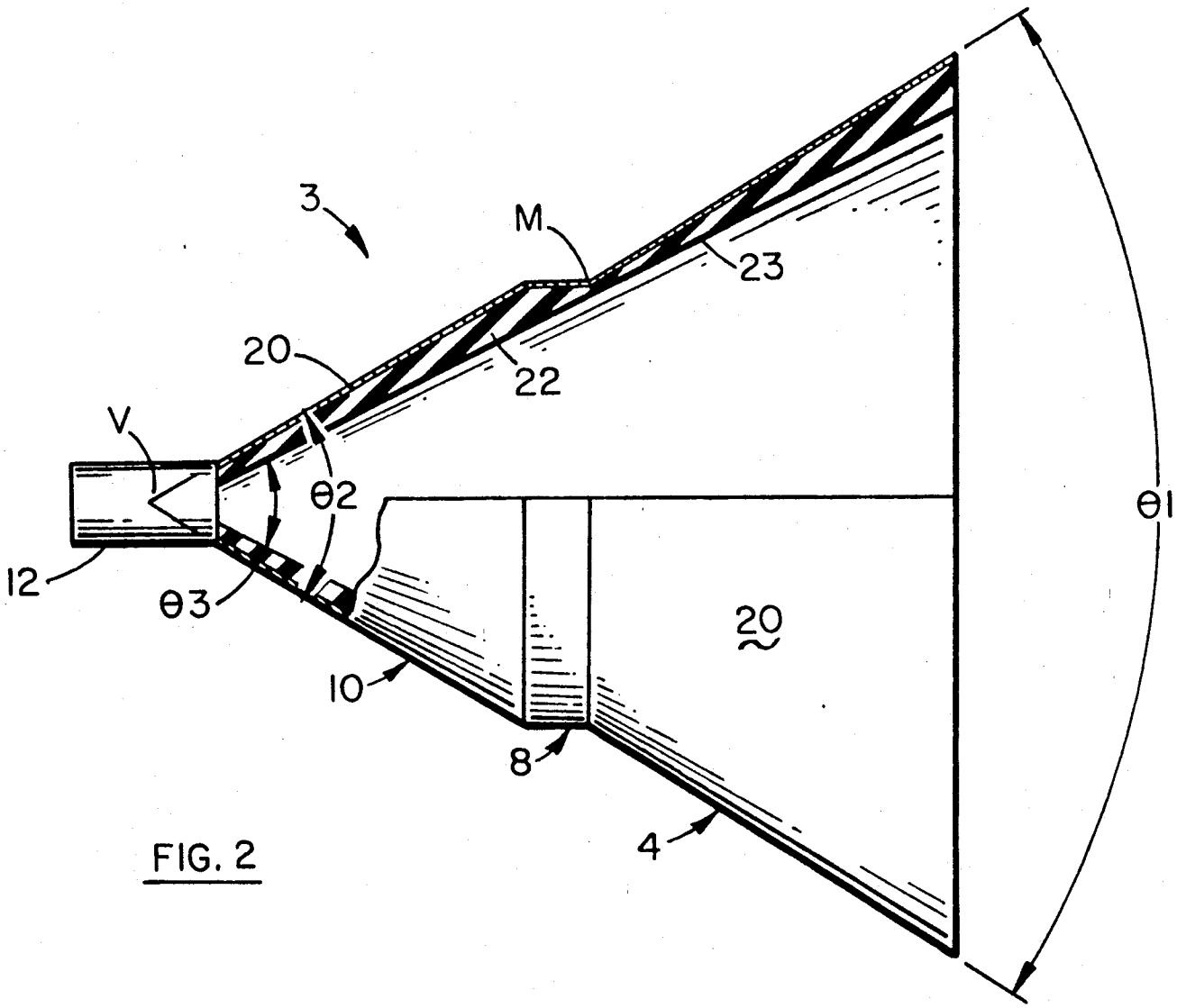
FIG. 2 shows a cross-section view through the interior of a coated antenna.

Directing additional attention to FIG. 2, a cross-section view is shown of the electrically active portion of an antenna 3, taken along a longitudinal center axis 17, which is constructed in the fashion of the antenna 2 of FIG. 1. FIG. 2 particularly depicts the internal construction of the antenna 3 and wherein a conductive thin film, layer 20 is deposited on the corresponding interior surface of a rigid outer antenna shell 32, shown in FIG. 3. The conductive layer 20 in one presently preferred embodiment comprises a seamless layer of high purity copper which is uniformly formed over the interior surface with minimal surface discontinuities. As is typical of other waveguide structures, the thickness of the layer 20 is controlled relative to the signal penetration depth and for the frequencies presently being considered is less than 10 micrometers in depth. Alternatively, a high purity silver paint, such as electroless silver, may be used. Still further, the layer 20 may be applied through a variety of known plating, sputtering or other thin film deposition techniques or may comprise a composite of conductive laminations, such as a silver conductive layer on a copper conductive layer.

Positioned in overlying relation to the conductor layer 20 is a dielectric layer 22 which for the embodiment of FIG. 2 is constructed of a high-purity paraffin wax, although it is to be appreciated any of a number of dielectric materials such as polyethylene, polystyrene, ceramic or the like may be used. Depending upon the type of dielectric, the manner in which it is applied may be varied from using a variety of available coating techniques to using pre-cast structures which are bonded to the antenna interior. Depending upon the construction and manner of attachment, the interface region between the conductor layer 20 and dielectric layer 22 must be considered as it affects the electrical properties of the antenna.

In any event, the dielectric layer 22 is applied such that a uniformly smooth, uninterrupted conical surface 23 at a flare angle $\theta 3$ is achieved which, in the ideal, radiates from the vertex "V" outwardly to just contacting the point of intersection "M" of the first stage 4 with the intermediate coupler stage 8. Although it is preferable that no discontinuities occur in the dielectric layer 22, empirically it has been determined that slight discontinuities at the vertex V and intersection points M of approximately one-sixteenth inch are to be tolerated without aggravating the signal gain achieved with the antenna 2. The thickness of the dielectric layer 22 may also be somewhat greater, such as where a precast structure is used, to facilitate handling of the casting. Similarly, it has been found that the dielectric need not cover all stages.

Relative to tolerances and for the frequencies being received, it is to be appreciated that the mentioned tolerances are relatively critical in that the wavelengths of the received signals are only on the order of one-half to one inch and thus relatively slight misalignments on the order of one-eighth to one-quarter inch can induce deleterious reflections and reduce the signal gain at the vertex V. In particular, a dimensional tolerance of 0.1 inches is preferred and which also is believed to be obtainable without unduly affecting the construction cost of an overall antenna assembly.

Recalling also the dimensions shown in Table 1 for the KU-band antennas of cases 1 and 2, it is to be further appreciated the overall antenna 3 as currently constructed measures only approximately eighteen to twenty-four inches in length and eight to ten inches in diameter at the signal receiving aperture, as distinguished from available C-band constructions which measure up to sixteen feet in diameter and KU-band constructions which measure two to six feet at the collector. Furthermore, the assembly 2 is constructed with an overall weight on the order of one to two pounds, while producing comparable signal gain values, suppressed side lobes, reduced beam width and relatively low cross polarization, in contrast to the electrical performance characteristics of the conventional reflector antenna constructions.

Figure 3:
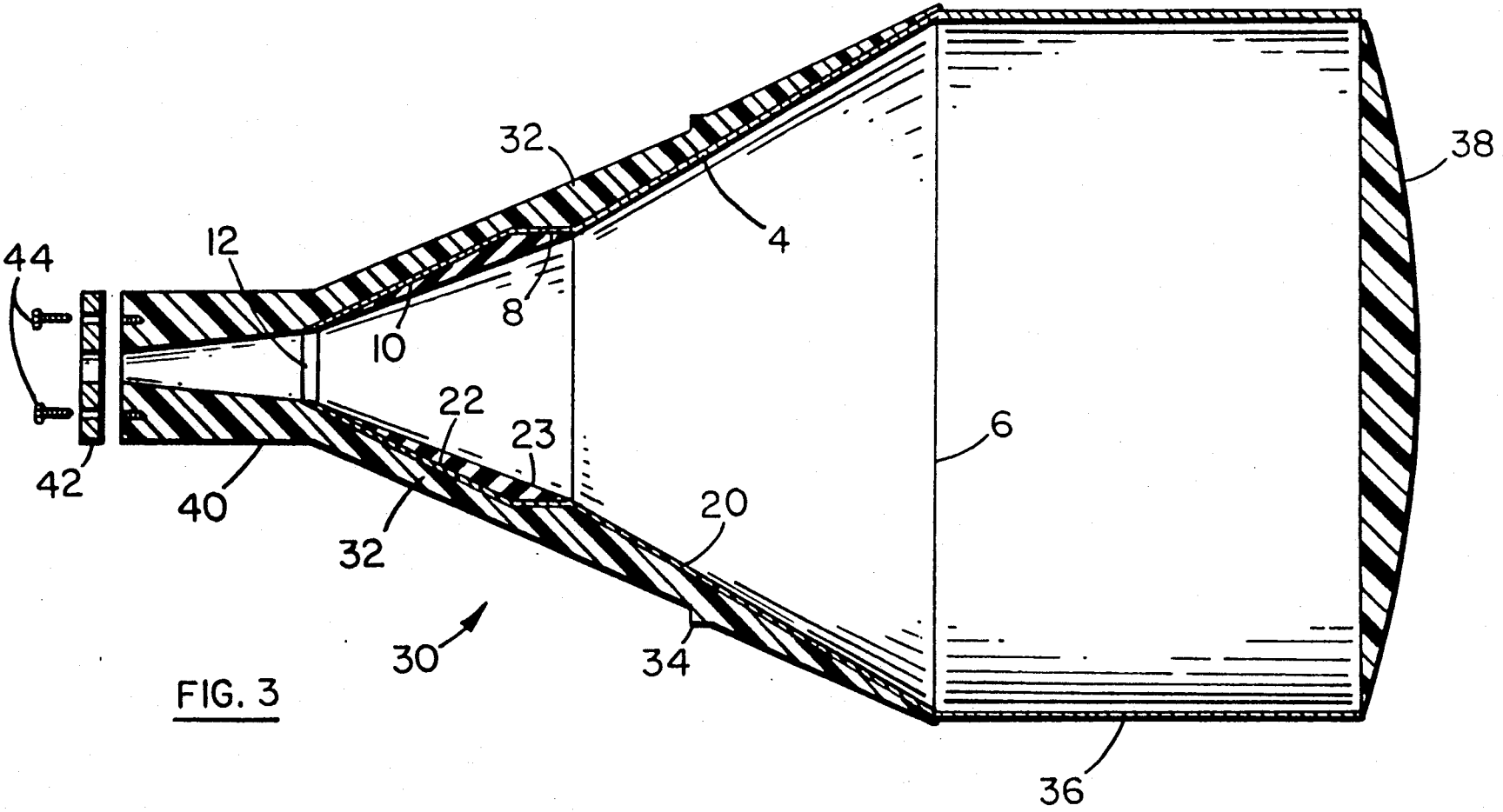
FIG. 3 shows a cross-section view through an antenna including a refractive focusing lens.

Turning attention next to FIG. 3 and with continuing attention to FIGS. 1 and 2, a cross-section view is shown of a complete antenna assembly 30 and wherefrom the outer shell 32 is more readily apparent relative to the above-described electrically active FIGS. 1 and 2. The outer shell 32 is intended to mechanically protect the internal conductor and dielectric layers 20 and 22, respectively. Accordingly, it is desirable that the shell 32 be as lightweight as possible, depending upon the application, yet provide sufficient rigidity under encountered uses. At present, the shell 32 is constructed as a compound structure includes a fiberglass inner shell, the interior of which exhibits the desired angular tapers, which is covered over with a resin/polyester skin and which collectively are denoted 32. An annular mounting ridge 34 or other flanges (not shown) are added as necessary to facilitate the handling and mounting of the antenna assembly 30 in associated communication systems, for example, an assembly such as disclosed hereinafter in FIG. 4.

Mounted to the signal receiving aperture 6 of the antenna 30 is a cylindrical spacer collar 36 which is transparent at the frequencies being received. Secured to the spacer's outer end is a forwardly facing refractive focusing lens 38, the focal point of which lens 38 is coincident with the longitudinal center axis 17 of the antenna 30.

Whereas FIG. 1 disclosed a forward facing partial hemispherical or concave reflective lens 14 surrounding the aperture 6, in combination with a relatively small spherical dielectric scatterer 19 mounted to the aperture 6, the lens 38 comprises a convex-shaped lens which tapers outward from a relatively thick center portion to relatively thin outer edges. Alternatively, it is to be appreciated a variety of other focusing lens shapes might be employed. Preferably, the lens 38 is constructed of a homogeneous dielectric similar to that of the layer 22, although a variety of other suitable dielectric materials may be used so long as they are supportable from the spacer 36 and in combination don't detract from the antenna's performance.

Figure 6:
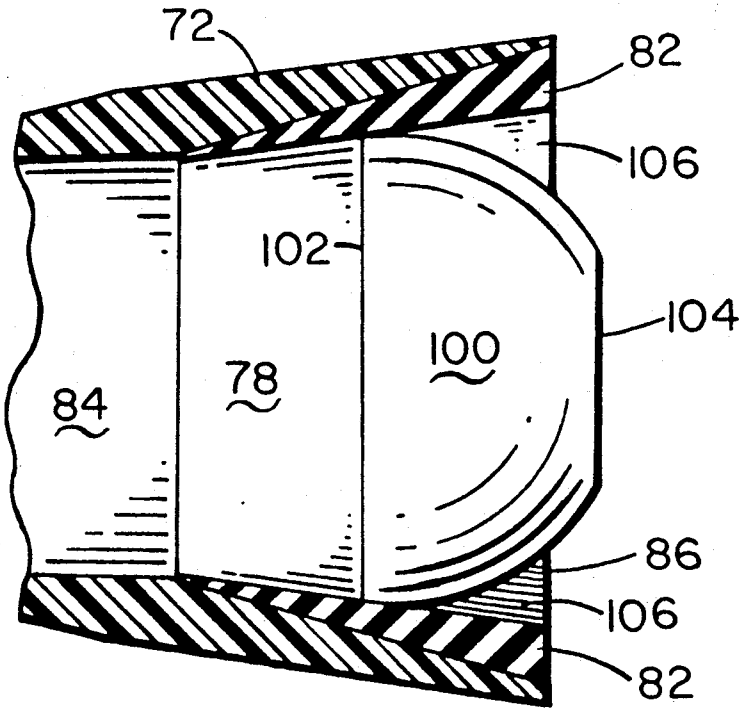
FIG. 6 shows a partial cross-sectional view of a flattened hemispherical scatterer mounted in a first stage.

In the latter regard, the spacer 36 comprises a cylindrical dielectric collar member which is adhesively or mechanically bonded to the aperture 6 or alternatively may constitute an extension of the shell 32. In lieu of a collar member, a plurality of struts might be provided with intermediate openings between the struts, but which assembly is believed to be less desirable in that greater opportunities for corrosion of the conductor layer 20 are thereby presented. Accordingly it is desirable that any spacer/lens assembly 36, 38 minimize exposure of the horn interior to corroding substances. FIG. 6 discloses a construction of a flattened hemishpherical scatterer mounted to close off the aperture 6.

In passing and mounted to the innermost end of the wave guide end 12 antenna 30 is a circular-to-rectangular waveguide transition region 40, a waveguide coupler 42 and its mounting hardware 44 which couple the received signal at frequencies usable by the receiver circuitry 18. From FIG. 3, it is also to be noted that the dielectric layer 25 conically covers only the stages 8 and 10.

The operation of the antenna structure of FIG. 1 has been validated for the relative frequency range of 8 to 12.5 gigahertz. Comparable on-axis gain values to currently known reflector/feedhorn antennas have been particularly obtained to the point where signal compatibility exists with conventional television receiver and amplifier circuitry 18 (see FIG. 1). Specifically, the antennas of Table I have demonstrated signal gain characteristics in the range of 30 db which, for the signal received at their relatively small signal receiving apertures 6, is sufficient to meet the input requirements of the receiver circuitry 18 (see FIG. 1).

Figure 4:
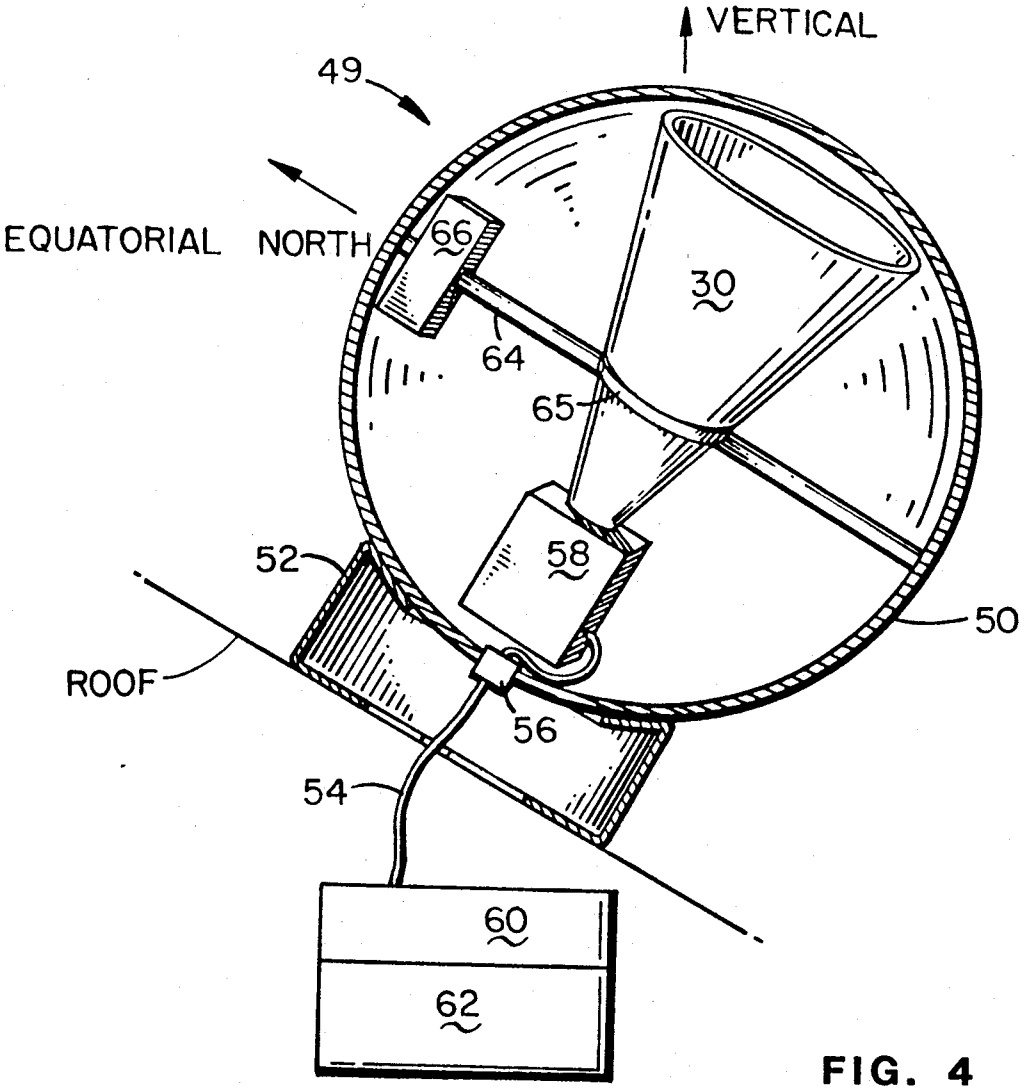
FIG. 4 shows a partial isometric view through a motorized antenna down link assembly.

Referring next to FIG. 4, a cross-section view is shown through one construction of a directional antenna assembly 49 as might find application in a satellite communications down link. Specifically, the assembly 49 of FIG. 4 comprises a rigid spherical shell or radome 50, typically less than twenty-four inches in diameter, which is transparent to the frequencies of interest being received. The shell 50 is securable to a mounting surface, such as for example the roof of a home or other structure, via an adjustably conforming mounting collar 52 wherein the shell 50 may be rotated until the antenna 30 and the support axle 64 are properly aligned. A shielded, stress relieved conductor 54, e.g. a multi-conductor coaxial cable, is mounted through a sealed, gas tight port 56 provided along the rear enclosure surface. The cable 54 couples the received electrical signals produced by the low noise block, down-converter 58 of conventional construction to the television tuner 60 and motor drive circuitry 62 mounted within the user's home.

The spherical radome 50 is used to prevent damage and possible corrosion to the horn antenna 30 from the elements. Additionally, the shell is filled with an inert gas such as nitrogen, which for various reasons may also be tagged with tracer gases, to protect the internal components, particularly conductor layer 20. Due to the small antenna size, the assembly 49 in a KU-band compatible construction provides an assembly which measures less than thirty inches in diameter.

Otherwise, the horn antenna assembly 30 via the annular mounting ridge 34 (reference FIG. 3) and clamping collar 65 is secured to the axle 64 with a single axis movement 64 (i.e. a north equatorial mount). The axle 64, in turn, is remotely driven via drive signals applied from the controller 62 to the motor 66. In the presently preferred embodiment, the controller 62 applies digital drive signals to a stepper motor movement 66.

The normal use and operation of the assembly 49 thus generally requires the initial mounting of the assembly 49 at a pre-defined equilibrium position relative to a vertical axis established upon leveling the assembly 49 and aligning the axle 64 with a true north compass heading. From this initial reference, the motor drive controller 62 thereafter rotates, under microprocessor control, the antenna 30 into proper alignment with the position coordinates of any number of stationary communication satellites orbitally positioned in the line of sight of the antenna's bore. If the satellite is moving or if the antenna system is transportable, a multi-axis mount and more sophisticated microprocessor tracking controller can be used to direct the antenna 30 to follow the satellite signal.

Figure 5:
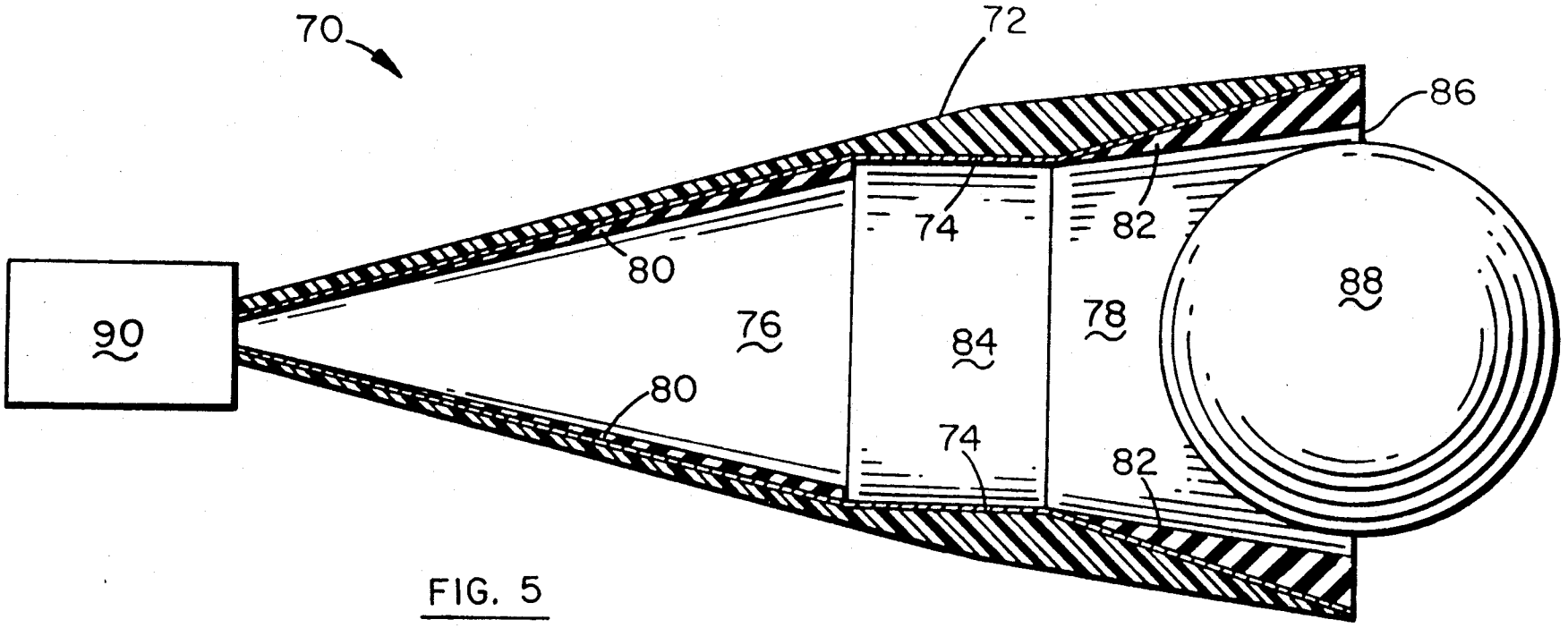
FIG. 5 shows a cross-section view through an antenna construction having independently mounted dielectric inserts at each of the stages relative to a dielectric scatterer which mounts within the aperture of the first stage.
Figure 9A:
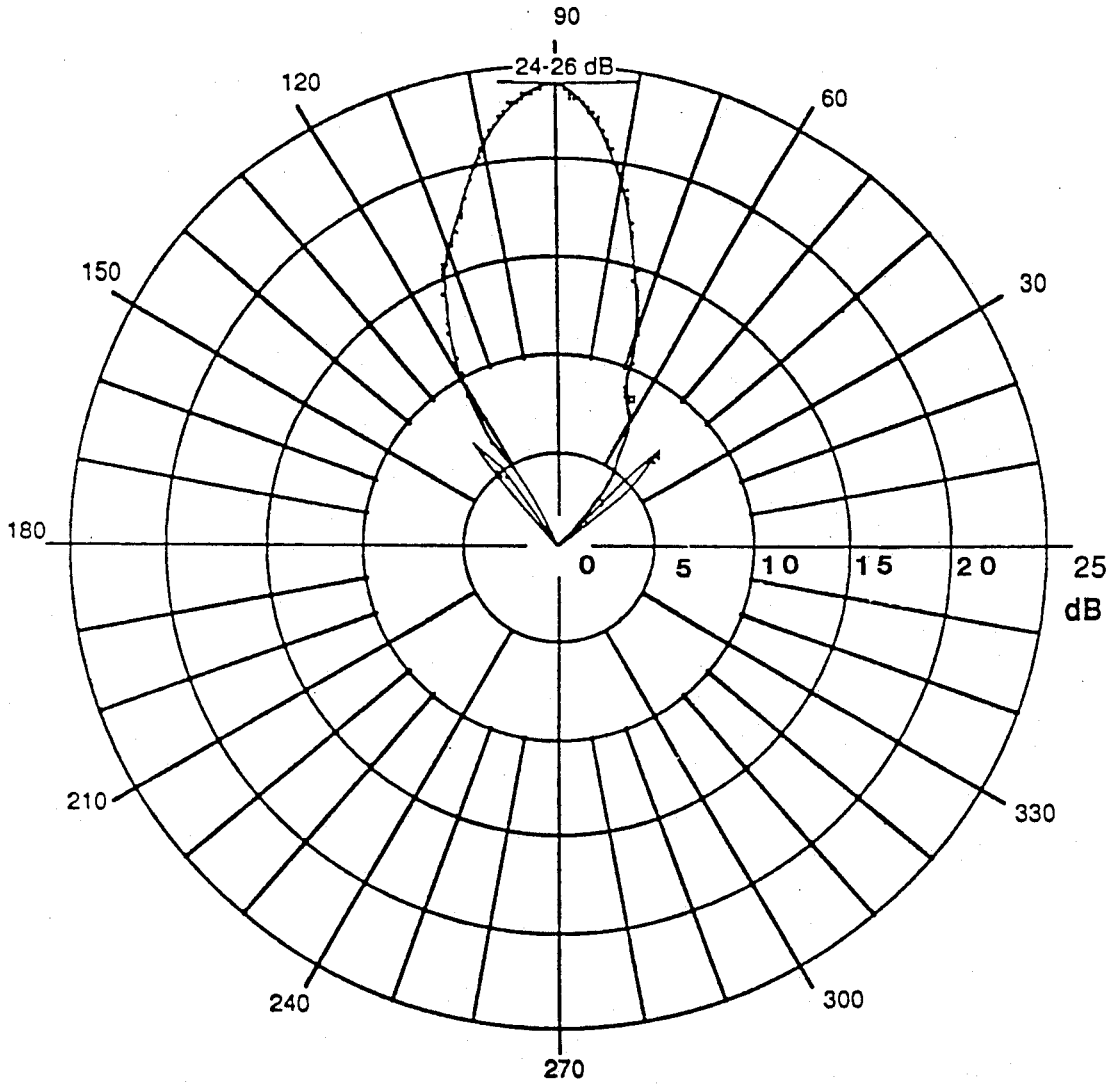
FIGS. 9*a*, 9*b* and 9*c* show polar waveforms of measured performance data for one of the antenna constructions of Table II with various interior horn treatments and the relative improvement in on-axis gain and reduction in beamwidth and side lobes.
Figure 9B:
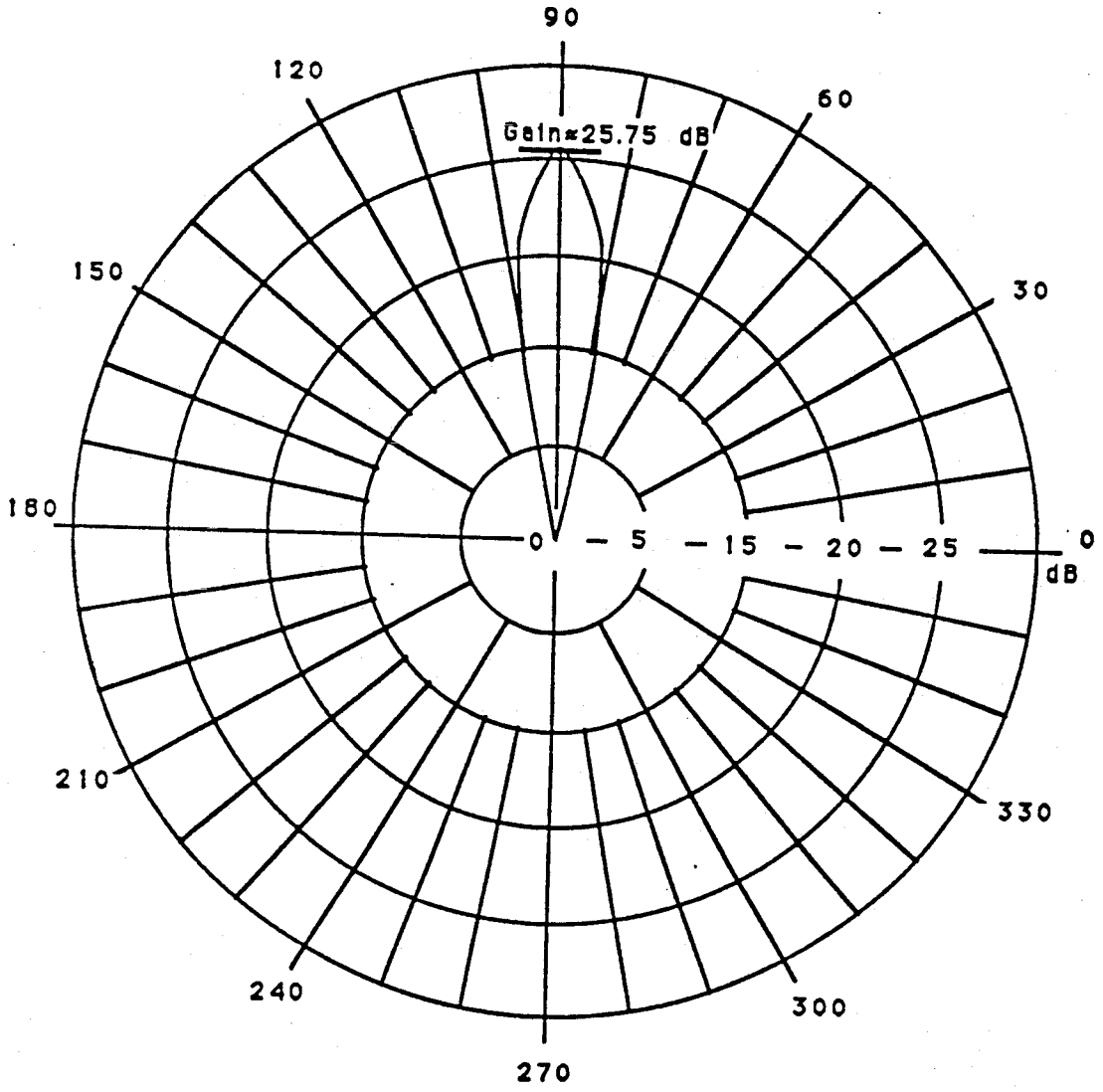
Figure 9C:
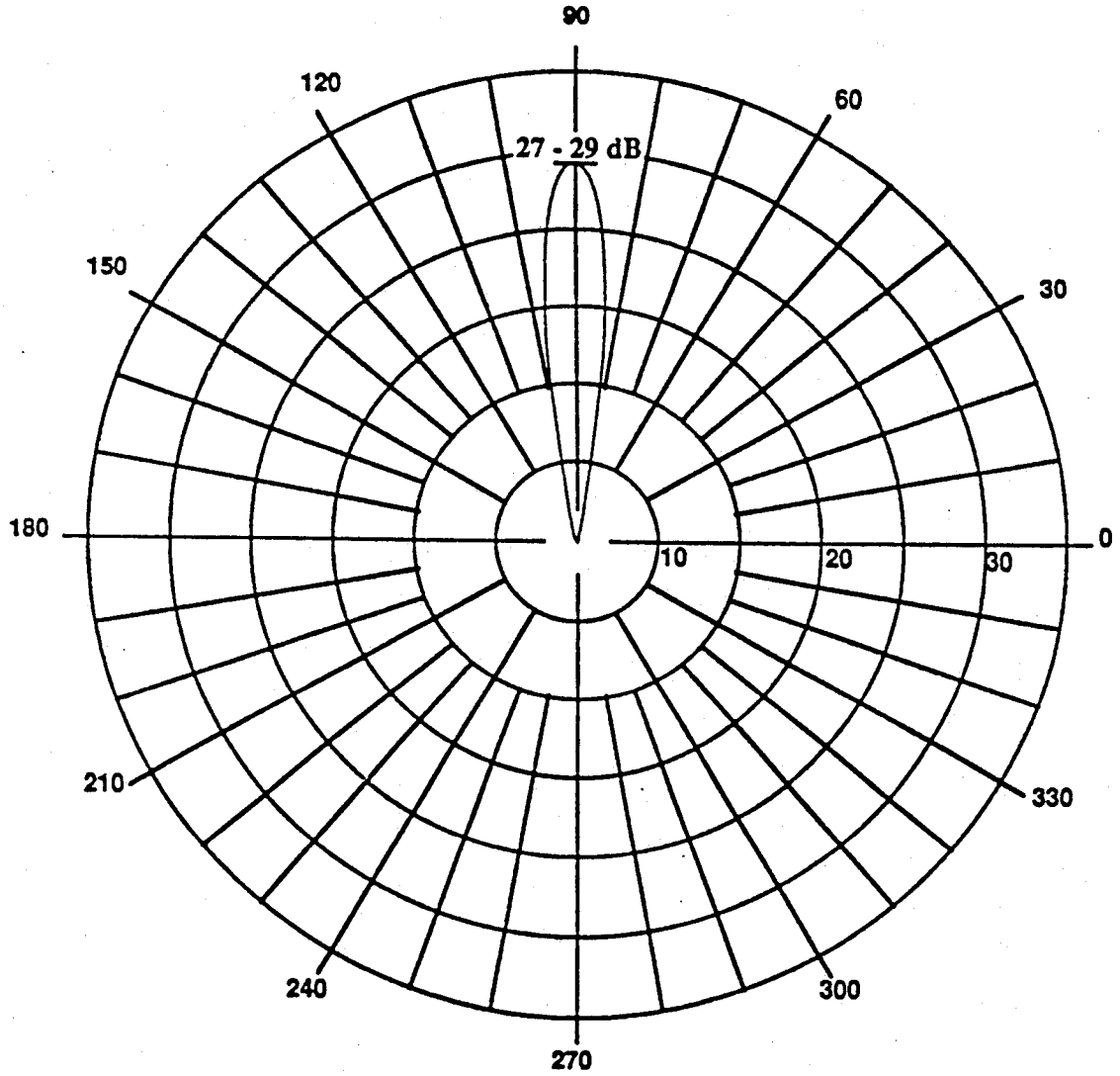

Referring to FIG. 5, a cross-section view is shown through an antenna structure 70 which is organized in a substantially similar fashion to the antenna 30 of FIG. 3. Table II below discloses a tabular listing of corresponding dimensions for various KU-band antennas constructed in this configuration. Table III below, in turn, discloses the measured gain for various ones of the antennas of Table 2, which gain values were variously measured for the various denoted interior dielectric treatments. FIGS. 9*a* to 9*c* further demonstrate the relative improvements in the measured electrical performance for one antenna construction (i.e. KU 11) with the variously indicated interior dielectric treatments referenced in Table III. All measurements for the Table II and III antennas correspond to the dimensional callouts A–F of FIG. 1.

TABLE II

| Model | A (cm) | B (cm) | C (cm) | D (cm) | E (cm) | F (cm) | 01/2 | 02/2 |
|---|---|---|---|---|---|---|---|---|
| KU 11 | 17 | 12 | 2.54 | 8.83 | 22.86 | 2 | 19.5 | 14.5 |
| KU 15.1 | 17.27 | 11.25 | 2.54 | 9.89 | 16.96 | 6.42 | 17 | 14 |
| KU 15.2 | 16.5 | 8 | 2.54 | 15.54 | 13.18 | 3.09 | 15.3 | 11.6 |
| KU 15.3 | 18.03 | 8.75 | 2.54 | 15.87 | 14.78 | 5.08 | 16.3 | 14.2 |
| KU 15.4 | 16.25 | 8 | 2.54 | 15.5 | 16.4 | 3.2 | 14.9 | 11.6 |
| KU 15.5 | 14.19 | 11.24 | 2.54 | 6.35 | 25.67 | 6.52 | 12.7 | 11 |
| KU 15.6 | 13.53 | 11.24 | 2.54 | 4.57 | 24.96 | 4.32 | 13.7 | 11.3 |
| KU 18.1 | 17.75 | 8 | 2.54 | 19 | 16.25 | 8.59 | 14 | 11.7 |
| KU 18.2 | 16.25 | 8 | 2.54 | 19 | 16.25 | 8.6 | 12.8 | 11.7 |

TABLE III

| Model | Gain (db) | BWDTH (deg). | Electrical configuration |
|---|---|---|---|
| KU 11 | 24.26 | 11 | Exposed conductor |
| KU 11 | 25.75 | 9 | Inserts 80, 82 |
| KU 11 | 27 (approx) | | Inserts 80, 82 and dense 88 |
| KU 11 | 27.29 | 7 | Inserts 80, 82 and foamed 88 |
| KU 15.1 | 23.8 | | Exposed conductor |
| KU 15.6 | 23.3 | | Exposed conductor |
| KU 18.7 | 23.3 | | Exposed conductor |
| KU 18.8 | 23.8 | | Exposed conductor |

The antenna 70 comprises a rigid outer shell 72 which is constructed over an appropriately shaped mandrel from a number of layers of a graphite impregnated cloth which are covered over with suitable epoxy resins. By forming the shell over a mandrel, a generally smooth interior shell surface is obtained. The interior can be further treated by way of a variety of known buffing and abrading techniques to achieve a suitably smooth interior surface.

Uniformly coated over the interior of the shell 72 is a conductor layer 74, which for the constructions of Table II comprised a spray applied electroless silver and which is applied to a depth in the range of 3 to 5 microns. With the exception of the KU 11 construction, the conductor layer 74 was applied directly to the shell 72. For the KU 11 construction, however, a laminated conductor was used and wherein an electroplated silver layer, approximately 5 microns thick, was applied over an electroless copper layer, approximately 0.5 microns thick.

Mounted within each of the respective inner and outer conical stages 76 and 78 are conically formed dielectric inserts 80 and 82. The outer surface of each insert 80, 82 is constructed to mate with the conical taper of the stages 76, 78. The inner surface flare angle $\theta 4$, $\theta 5$ of the inserts 80, 82 taper in the range of 2 to 5 degrees relative to the outer surface of the insert. As mentioned, a variety of dielectric materials may be used, although for the constructions of Table II, the inserts were fabricated from a molded polyethylene material of a uniform density throughout the insert structure. Also, the flare angles of the inserts may be different from each other.

The conductor layer 74 at the center cylindrical stage 84 is thus uncoated. In various antenna constructions, it might, however, include a tubular dielectric insert of appropriate wall thickness (not shown). The inclusion of such an insert has been shown to reduce cross polarization of the E–H planes.

Mounted interiorly of the outer stage 78 is a spherical scatterer 88 which is constructed to have a diameter essentially the same as the A dimension of the aperture 86. Such a scatterer mounting configuration is in contrast to that of the relatively small scatterer 19 shown in FIG. 1.

Applicants have also found that by variously controlling the length, thickness and density of the dielectric inserts 80, 82 and the scatterer 88 relative to one another, improved on-axis gain and antenna directivity can be obtained. Moreover, such improved gain is achieved with relatively low signal cross-polarization and suppressed side lobes. These electrical improvements are demonstrated in Table III and FIGS. 9*a* to 9*c*.

Polar waveforms 9*a* to 9*c* particularly disclose relative measured electrical gain and side lobe data for the KU 11 antenna construction. The FIG. 9*a* measurements were taken with an exposed conductor layer 20 and although demonstrating acceptable gain for some applications, small side lobes are present. Upon inserting the double flared conical dielectric inserts 80 and 82, the on-axis gain increases and the side lobes are reduced as shown in FIG. 9*b*. The beam width, which is measured at the 3 db points on either side of the center vertical axis, also narrows. By adding a foamed scatterer 88 at FIG. 9*c*, the on-axis gain is improved further and the beam width narrows again. As is therefore apparent from these waveforms, the variation of the interior dielectric treatments at the conical stages 4, 8 and 10 and the aperture 6, induces improvement of the on-axis gain, as the beam width is narrowed and the side lobes are essentially reduced to zero. It accordingly is believed that comparable results will be achieved by similarly varying the interior treatments of others of the considered antenna constructions.

At present, the dielectric material for the inserts 80, 82 and the scatterer 88 are homogeneous in nature, although in suitable circumstances, they might be varied; this may occur between structures or within each structure. Similarly, the relative densities of each material might be appropriately tailored. In the latter regard, Applicants have discovered that a foamed or air entrained dielectric scatterer 88 improves the antenna's gain, in contrast to using a similarly configured solid dielectric. It is believed that a dielectric constant of the composite of all the inserts and the scatterer 88 in the range of 1.5 to 2.5 is to be preferred.

A further object of sizing the scatterer 88 to closely approximate the aperture 86 is to permit the mounting of all or a substantial portion of the scatterer 88 within the aperture 86. The advantage of such a mounting is that the interior of the antenna 70 is thereby essentially sealed off from the external environment and potential contamination to any exposed portions of the conductor layer 74. It being recalled that the conductor layer might be variously exposed, either at the center stage 84 as depicted or should the antenna use shorter length inserts 80 and 82 than those depicted. With a sealed mounting, it might also be desirable to create a gas tight seal and fill the horn interior with a suitable inert gas, thereby doing away with the necessity of a radome 50.

Figure 5A:
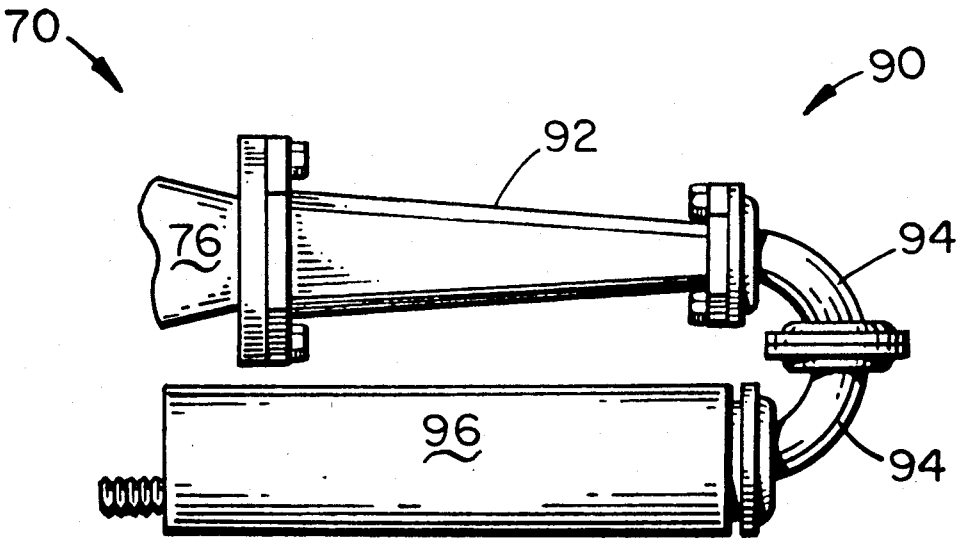
FIG. 5*a* shows a view of the signal conversion circuitry of the antenna of FIG. 5.

With attention also to FIG. 5*a* and mounted to the innermost end of the antenna 70 is the signal conversion circuitry 90 which for the antennas of Table 2 comprises a circular to rectangular transition section 92, an H-plane bend section 93 having two 90 degree portions 94 and a low noise block receiver 96. Presently, Applicants use a model KU117HMT receiver manufactured by California Amplifier.

Turning attention next to FIG. 6, a partial cross-section view is shown through the antenna 70 of FIG. 5 (less the conductor 74), and wherein the dielectric scatterer 100 comprises a flattened hemispherical structure. That is, in lieu of spherical scatterer 88, the scatterer 100 exhibits a hemispherical shape having a flattened inner surface 102 and a flattened outer surface 104. The scatterer is also constructed of an air entrained polyethylene material. Although a slight gap 106 occurs between the scatterer and the insert 82, the shape of the scatterer might be suitably varied to remove any such gap 106.

Figure 7:
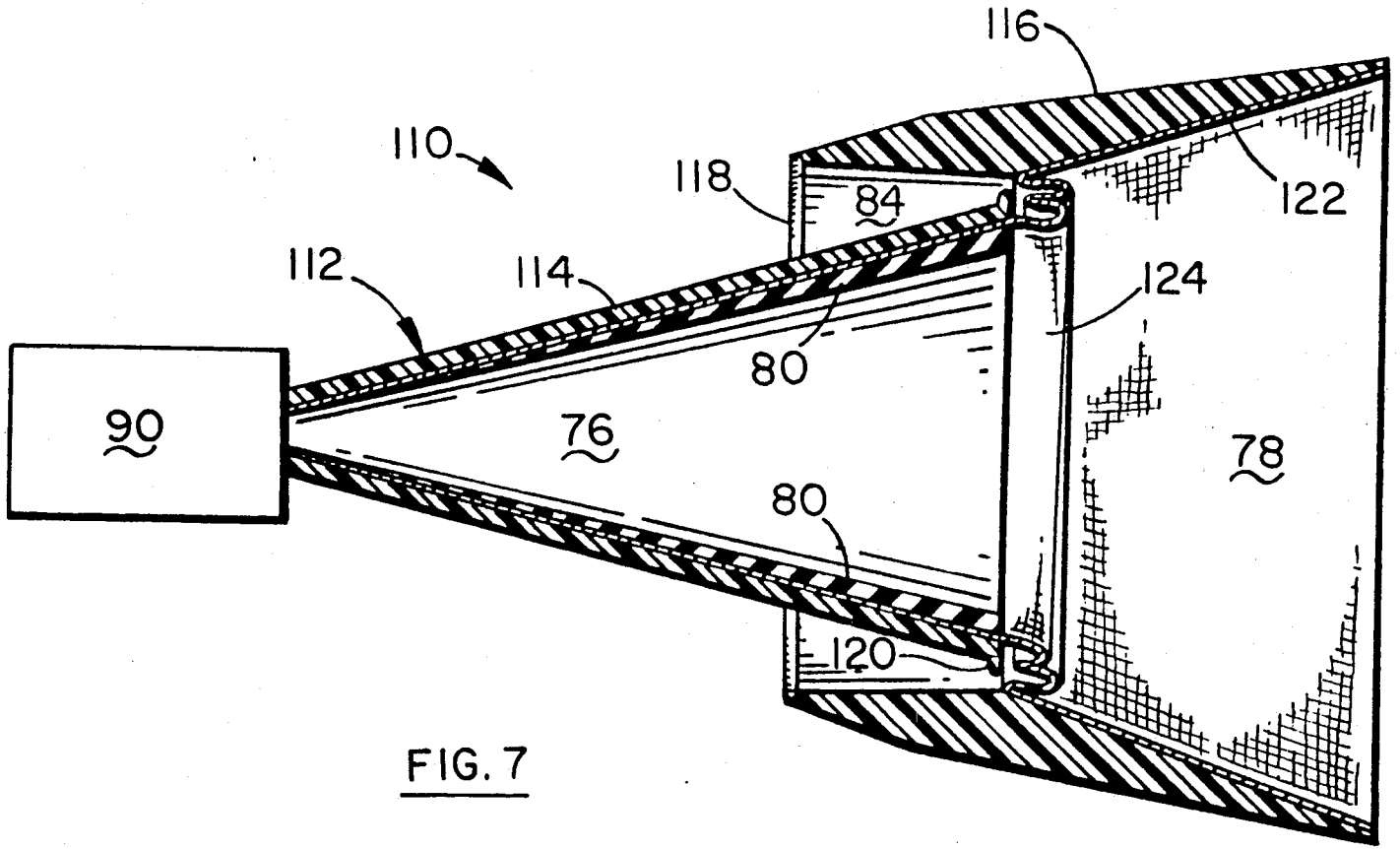
FIG. 7 shows a cross-section view through a telescoping antenna construction.

With attention next directed to FIG. 7, a cross-section view is shown through a telescoping antenna construction 110 which is constructed in a similar fashion as the antenna 70 of FIG. 5. In particular, the external fiberglass shell 112 is constructed of two telescoping portions 114 and 116. The antenna portions 114, 116 are configured to mount to one another to form a composite antenna shell construction comparable to that of the shell 72. A suitably formed coupler ring 118 (shown as a groove) is provided at the inner end of the portion 116 which mates with the outer end 120 (shown as a bead) of the portion 114. An O'ring seal (not shown) or other conventional sealing means might be employed at this joint to assure a weathertight connection. A clamp coupler (not shown) might also be employed to further strengthen the joint. Interlocking grooves might be formed in the shell portions 114, 116 such that upon drawing the portion 116 forward, the grooves mate with one another.

In lieu of using a painted conductor layer, a flexibility conductive layer 122 is provided over the inner surface of the antenna portions 114 and 116. For example, a variety of woven wire fabrics or metalized plastic laminates may be used. Any selected material must exhibit suitable surface conductivity at microwave frequencies. Otherwise, the flexible conductor layer 122 is bonded to the interiors of the antenna portions 114 and 116, with only a flexible joint 124 occurring at or near the point where the antenna portions couple to one another.

Figure 8A:
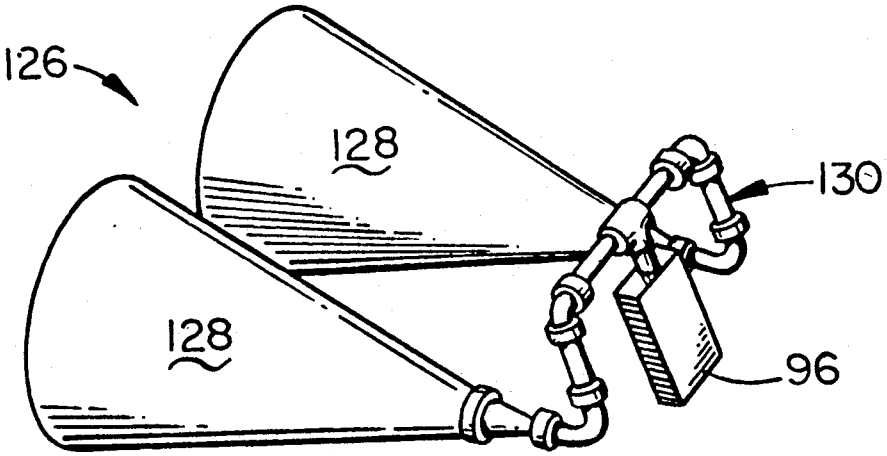
FIG. 8*a* shows a two antenna linear, phased array of the present antennas.
Figure 8B:
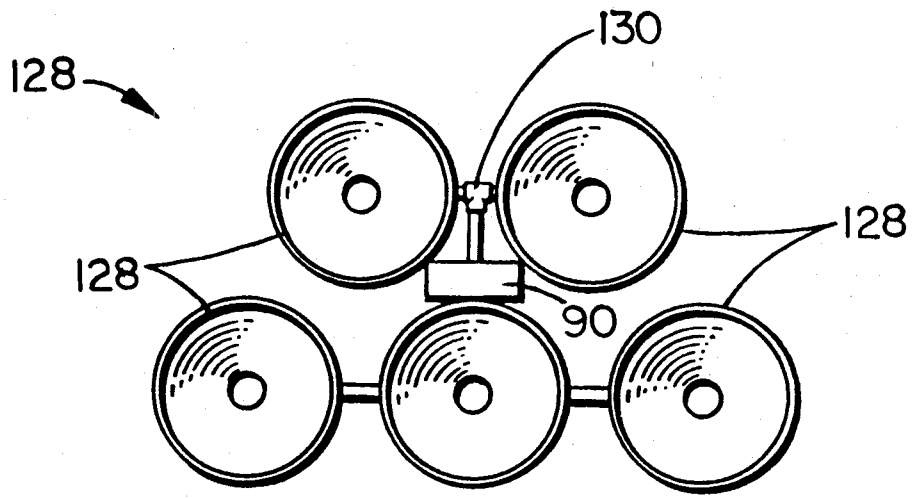
FIG. 8*b* shows a 2×3 phased array of the present antennas.

FIGS. 8*a* and 8*b* disclose alternative array configurations 126 and 127 of the present antenna construction wherein the horn apertures of a number of identical antennas 128 are respectively mounted in a linear array and in a 2×3 planar array. Connecting each of the antennas to one another and the block receiver 96 in an appropriate fashion is waveguide hardware 130. The phasing of the beams of the composite antenna mount are overlapped onto one another such that a relatively stronger signal gain is achieved with reduced beam width. Moreover, due to the already small size, narrow beam width and low side lobes of the antennas 128, it is contemplated that the arrays 126 and 127 can be mounted in relatively small physical configurations and be able to communicate with satellites in relatively close orbits to one another, without interference from adjacent antennas.

Although the present invention has been described with respect to its presently preferred and various alternative embodiments, it is to be appreciated still other embodiments might be suggested to those of skill in the art upon reference thereto. Accordingly, it is contemplated that the invention should be interpreted to include all those equivalent embodiments within the spirit and scope of the following claims.

What is claimed is:

1. A multimode antenna for receiving and transmitting electromagnetic radiation, comprising:

(a) a housing having an interior which includes a first region having an outer aperture which conically tapers inward at a first flare angle to a cylindrical region and from an inner edge of which cylindrical region a second region conically tapers inward at a second flare angle less than said first flare angle to an inner aperture, wherein each of said regions is coaxial with the others and a longitudinal axis and wherein a ratio of the diameter of said outer aperture to the distance along said longitudinal axis between said outer and inner apertures is greater than or equal to one-half;

(b) a conductor overlying the interior of said housing;

(c) first dielectric means at least partially mounted within the housing for focusing said radiation to said longitudinal axis;

(d) second dielectric means mounted within the housing and contacting the conductor for reconstituting said radiation within said housing; and (e) wherein the first and second dielectric means are arranged relative to each other such that the antenna is capable of far-field communications, independent of a reflective collector.

2. Apparatus as set forth in claim 1 including circular-to-rectangular waveguide transition means extending rearward from said inner aperture.

3. Apparatus with respect to claim 1 including means for supporting said first dielectric means to said outer aperture.

4. Apparatus as set forth in claim 3 wherein the supporting means comprises a cylindrical ring coupled between said first dielectric means and the outer aperture and includes means for sealing an inert gas within the interior of said housing.

5. Apparatus as set forth in claim 3 wherein said supporting means comprises a plurality of struts which extend from the outer aperture.

6. Apparatus as set forth in claim 1 including a weatherproof radiation-transparent enclosure mounted about said antenna.

7. Apparatus as set forth in claim 6 including means coupled to said antenna for aligning the longitudinal axis with predetermined spatial coordinates.

8. Apparatus as set forth in claim 1 wherein said first dielectric means includes a surface which refracts said radiation.

9. Apparatus as set forth in claim 8 wherein said refractive surface is spherical.

10. Apparatus as set forth in claim 1 wherein half of said first flare angle is in the range of 24 to 34 degrees and half of said second flare angle is in the range of 20 to 30 degrees and a portion of said first dielectric means conformally contacts said conductor.

11. Apparatus as set forth in claim 1 including means mounted to said outer aperture and coaxial with said longitudinal axis for prefocusing said radiation to said longitudinal axis.

12. A multimode antenna for receiving and transmitting electromagnetic radiation having a wavelength λ of X meters, comprising:

(a) a housing including a first stage which conically tapers inward at a first flare angle from an outer aperture having a diameter greater than or equal to approximately 6 X and a second stage which conically tapers inward at a second flare angle, wherein each of said first and second stages is coaxially aligned relative to a longitudinal axis and a cylindrical stage mounted therebetween, and wherein the first flare angle is greater than the second flare angle;

(b) a conductor overlying the interior of said housing;

(c) first dielectric means at least partially mounted within the housing for focusing said radiation to said longitudinal axis;

(d) second dielectric means contacting the conductor in a region of at least one of said stages for reconstituting said radiation within said housing; and (e) wherein the first and second dielectric means are arranged relative to each other such that the antenna is capable of far-field communications, independent of a reflective collector.

13. Apparatus as set forth in claim 12 wherein half of the first flare angle is in the range of 24 to 34 degrees.

14. Apparatus as set forth in claim 12 wherein half of the second flare angle is in the range of 20 to 30 degrees.

15. Apparatus as set forth in claim 12 wherein half of the first flare angle is in the range of 24 to 34 degrees and half of the second flare angle is in the range of 20 to 30 degrees.

16. Apparatus as set forth in claim 12 wherein said conductor comprises a metalized layer.

17. Apparatus as set forth in claim 12 wherein said first dielectric means includes a portion which contacts the outer aperture and seals an inert gas within the interior of the housing.

18. A multimode antenna for receiving and transmitting electromagnetic radiation, having a wavelength λ of X meters, comprising:

(a) a housing having an interior which includes a first region which conically tapers inward from an outer aperture having a diameter greater than or equal to 6 X at a first half flare angle in the range of 24 to 34 degrees to a forward end of a cylindrical region and from an aft end of which cylindrical region a second region conically tapers at a second half flare angle in the range of 20 to 30 degrees to an inner aperture and wherein each of said regions is coaxial with the others of said regions and a longitudinal axis and wherein a ratio of the diameter of said outer aperture to the distance along said longitudinal axis between said outer and inner apertures is greater than or equal to one-half;

(b) a conductor overlying the interior of said housing;

(c) first dielectric means at least partially mounted within the housing for focusing said radiation to said longitudinal axis;

(d) second dielectric means contacting the conductor in at least one of said regions for reconstituting said radiation within said housing relative to said longitudinal axis; and (e) wherein the first and second dielectric means are arranged relative to each other such that the antenna is capable of far-field communications, independent of a reflective collector.

19. Apparatus as set forth in claim 18 including:

(a) means for sealing an inert gas within the interior of the housing;

(b) means for supporting said housing to a resting surface; and (c) means for axially aligning said longitudinal axis with predetermined spatial coordinates.

20. A multimode antenna for receiving and transmitting electromagnetic radiation having a wavelength λ of X meters, comprising:

(a) a housing having an interior which includes a first region having an outer aperture exhibiting a diameter that is greater than or equal to 6 X and which conically tapers inward at a first flare angle to a cylindrical region and from an inner edge of which cylindrical region a second region conically tapers at a second flare angle less than said first flare angle to an inner aperture and wherein each of said regions is coaxial with the others relative a longitudinal center axis;

(b) a conductor overlying the interior of said housing;

(c) dielectric means including a first portion at least partially mounted within the housing for focusing said radiation to said longitudinal axis and a second portion mounted to contact the conductor in at least one of said regions for reconstituting said radiation within said housing and d) wherein the first and second dielectric portions are arranged relative to each other such that the antenna is capable of far-field communications, independent of a reflective collector.

21. Apparatus as set forth in claim 20 including seal means comprising a portion of the first portion of the dielectric means which mounts relative to the outer aperture for sealing an inert gas within the interior of said housing.

22. Apparatus as set forth in claim 20 wherein the first portion of said dielectric means projects from the interior of said housing.

23. Apparatus as set forth in claim 20 wherein the first and second portions comprise a plurality of sections and wherein each section has a unique dielectric constant and at least two of said sections have different dielectric constants from the other sections.

24. Apparatus as set forth in claim 20 wherein said conductor comprises at least first and second conductive layers overlying one another.

25. Apparatus as set forth in claim 20 wherein said conductor comprises a continuous flexible member and said housing comprises a plurality of separable sections which mount in collapsible, telescoping relation to one another along said conductor.

26. Apparatus as set forth in claim 20 including a plurality of said antennas, wherein the outer apertures of each of which antennas are mounted in a planar array adjacent one another, means for converting received radiation to an electrical signal and means for coupling each of said antennas to one another and to said converting means.

27. Apparatus as set forth in claim 20 including a plurality of said antennas, wherein the outer apertures of each of which antennas are mounted in a line adjacent one another, and means for coupling each of said antennas to one another and means for converting received radiation to an electrical signal.

28. Apparatus as set forth in claim 20 wherein the second portion of said dielectric means includes a surface which conformally contacts said conductor.

29. Apparatus as set forth in claim 23 wherein ones of the plurality of sections of said dielectric means include a surface conformally mating with the conductor.

30. A multimode antenna for receiving and transmitting electromagnetic radiation, comprising:

(a) a housing, the interior of which includes a first region having an outer aperture which conically tapers inward at a first flare angle to a cylindrical region and from an aft edge of which cylindrical region a second region conically tapers at a second flare angle less than said first flare angle to an inner aperture and wherein each of said regions is coaxial with the others relative a longitudinal center axis and wherein a ratio of a diameter of said outer aperture to the distance along said center axis between said inner and outer apertures is greater than or equal to one-half;

(b) a conductor overlying the interior of said housing;

(c) dielectric means including a first portion at least partially mounted within the housing for focusing said radiation to said longitudinal axis and a second portion for reconstituting said radiation within said housing;

(d) means for sealing the interior of the housing from a surrounding environment; and (e) wherein the first and second portions of the dielectric means are arranged relative to each other such that the antenna is capable of far-field communications, independent of a reflective collector.

31. Apparatus as set forth in claim 30 wherein said second portion comprises a plurality of sections, and wherein at least two of such sections have distinct dielectric constants.

32. An antenna for receiving and transmitting electromagnetic radiation comprising:

(a) a housing comprised of a plurality of sections and means for telescopically mounting each of the sections to one another relative to a longitudinal axis, such that when assembled, a housing interior provides a first region having an outer aperture which tapers inward from said outer aperture at a first flare angle to a forward end of a cylindrical region and from an aft end of which cylindrical region a second region conically tapers at a second flare angle less than said first flare angle to an inner aperture and wherein each of said regions is coaxial with the others relative to said longitudinal axis;

(b) a continuous flexible conductor coupled to said inner and outer apertures to conformally overlay the interior of said housing when assembled; and (c) dielectric means mounted within said housing for reconstituting said radiation within said housing.

33. A multimode antenna for receiving and transmitting electromagnetic radiation, having a wavelength $\lambda$ of X meters, comprising:

(a) a housing having an interior including a first region which conically tapers inward at a first flare angle from an outer aperture having a diameter that is greater than or equal to 6 X to a forward end of a cylindrical region and from an aft end of which cylindrical region, a second region conically tapers at a second flare angle less than said first flare angle to an inner aperture, wherein each of said regions is coaxial with the others of said regions and a longitudinal axis and wherein a ratio of the diameter of said outer aperture to the distance along said longitudinal axis between said outer and inner apertures is greater than or equal to one-half;

(b) a conductor overlying the interior of said housing;

(c) first dielectric means mounted to partially extend from the interior of said housing for focusing said radiation to said longitudinal axis;

(d) second dielectric means for reconstituting said radiation within said housing; and (e) wherein the first and second dielectric means are arranged relative to each other such that the antenna is capable of far-field communications, independent of a reflective collector.

* * * * *